United States Patent [19]

Bridges et al.

[11] Patent Number: 4,800,350

[45] Date of Patent: Jan. 24, 1989

[54] DIELECTRIC WAVEGUIDE USING POWDERED MATERIAL

[75] Inventors: William B. Bridges; William M. Bruno, both of Pasadena, Calif.

[73] Assignee: The United States of America as represented by the Secretary of the Navy, Washington, D.C.

[21] Appl. No.: 737,122

[22] Filed: May 23, 1985

[51] Int. Cl.[4] ..... H01P 3/16

[52] U.S. Cl. ..... 333/239; 333/241; 333/242; 333/248

[58] Field of Search ..... 333/239, 242, 248, 241; 29/600; 350/96.30, 96.32

[56] References Cited

U.S. PATENT DOCUMENTS

| | | | |
|---|---|---|---|
| 2,897,461 | 7/1959 | Ashbaugh et al. | 333/239 |
| 2,996,686 | 8/1961 | Okaya | 333/248 X |
| 3,157,847 | 11/1964 | Williams | 333/239 |
| 3,435,401 | 3/1969 | Epstein | 174/68.5 |
| 4,097,826 | 6/1978 | Knox et al. | 333/247 X |
| 4,422,719 | 12/1983 | Orcutt | 350/96.32 X |

FOREIGN PATENT DOCUMENTS

| | | | |
|---|---|---|---|
| 0166804 | 10/1983 | Japan | 333/242 |
| 1558404 | 1/1980 | United Kingdom | 350/96.32 |

OTHER PUBLICATIONS

Kelly, J. M., et al; "Wave-Guide Measurements in the Microwave Region on Metal Powders suspended in Paraffin Wax"; *Journal of Applied Physics;* vol. 24, No. 3, Mar. 1953; pp. 258-262.

*Primary Examiner*—Eugene R. Laroche
*Assistant Examiner*—Benny T. Lee
*Attorney, Agent, or Firm*—Kenneth W. Hairston; Joseph M. St. Amand

[57] ABSTRACT

A flexible low-loss dielectric waveguide is made from a flexible low-dielectric constant hollow cylinder filled with high-dielectric constant powder. Alternatively, a rigid or semi-rigid waveguide comprises a groove formed in a low-dielectric constant substrate filled with high-dielectric constant powder.

18 Claims, 2 Drawing Sheets

DIELECTRIC WAVEGUIDE USING POWDERED MATERIAL

This invention relates to waveguides and more particularly to a low-loss flexible waveguide having optimized dielectric properties. Alternatively, a rigid or semi-rigid waveguide may be formed in complicated physical shapes.

BACKGROUND OF THE INVENTION

Dielectric waveguides have been made in many forms for perhaps 70 years. Optical fibers use glass on glass or liquid-filled glass tubes; microwave versions have used plastic cores covered with foam or uncovered. Optical integrated circuits have used various techniques, but all in solid form. None of the prior art dielectric waveguides use a powdered dielectric.

SUMMARY OF THE INVENTION

A low-loss flexible dielectric waveguide is realized by filling a flexible low-dielectric constant cylinder with a high-dielectric constant powder. The low-dielectric constant cylinder may be thin-wall Teflon "spagetti" insulation, for example, and the powdered dielectric may be barium tetratitanate, for example. An alternate rigid or semi-rigid version of this waveguide may be realized by filling grooves in the surface of a block of low-loss dielectric material with a high-dielectric constant powder. The grooves may be milled or thermally embossed in polypropylene, for example, and filled with barium tetra-titanate powder. Various useful microwave and millimeter wave components, such as ring resonators, band-dropping filters, band-pass filters, directional couplers, etc. may be realized using waveguides of the present invention.

DESCRIPTION OF THE PREFERRED EMBODIMENTS

Figure 1:
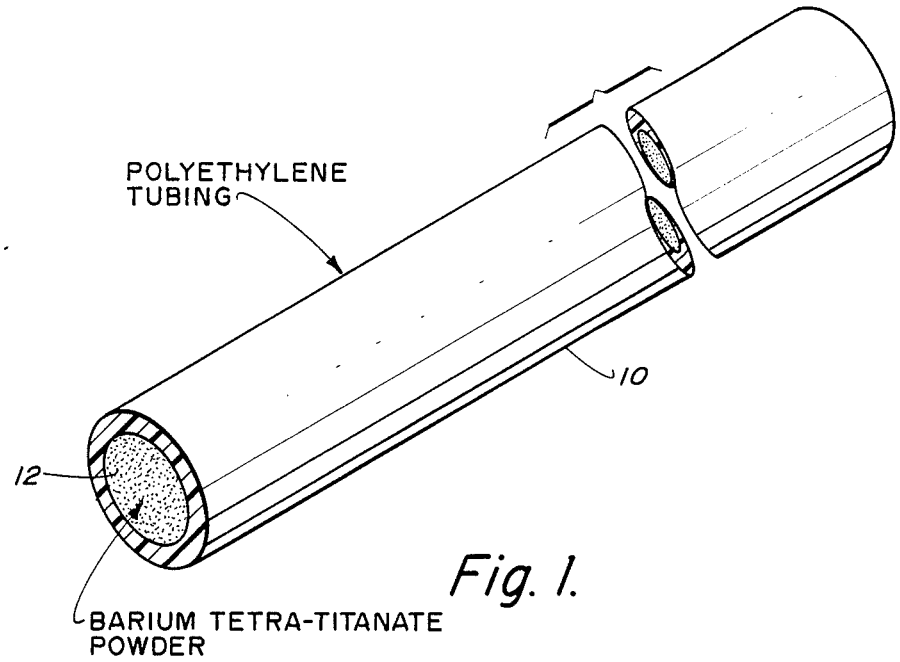
FIG. 1 is an illustration of a length of flexible low-dielectric constant tubing filled with a high-dielectric constant powder, as one embodiment of the invention.
Figure 2:
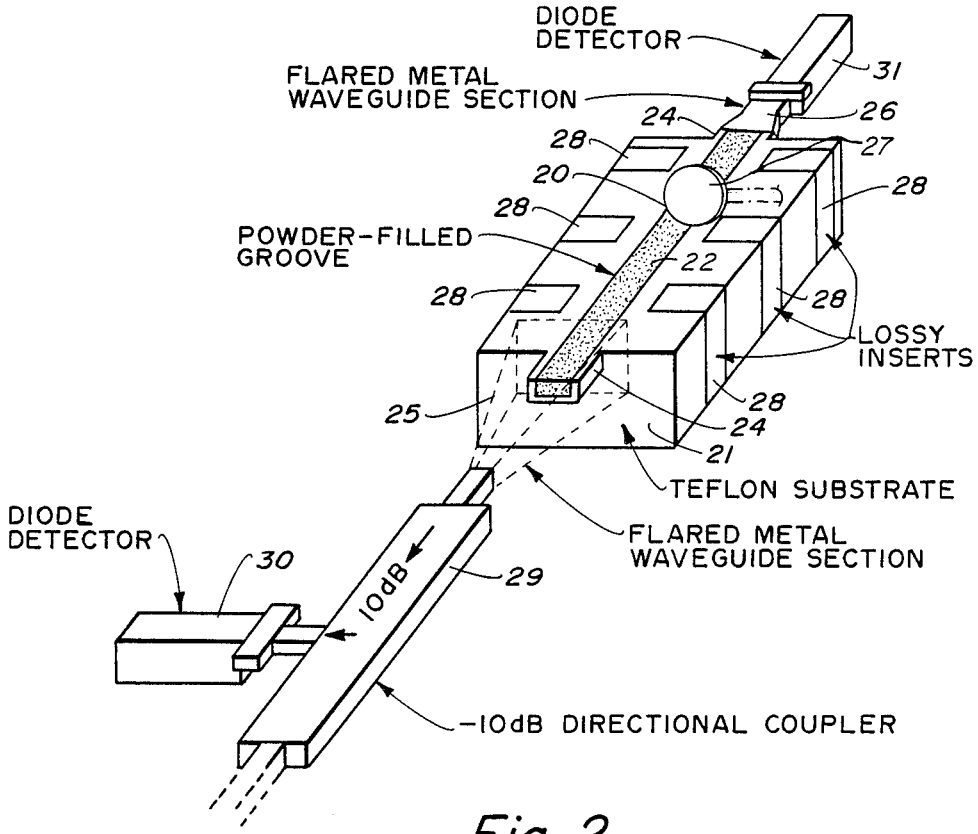
FIG. 2 shows another embodiment of the invention where a groove is formed in a rigid or semi-rigid substrate of low-dielectric constant and filled with a high-dielectric constant powder; in this illustration the waveguide section is connected for measurement purposes.

Flexible waveguides constructed of low-dielectric constant tubing 10, using a flexible polymer such as polyethylene or Teflon, for example, as shown in FIG. 1, are filled with a high-dielectric constant powder 12, such as barium tetra-titanate. Flexible tubing having a wall thickness of 0.039 inch and an inner diameter of 0.232 inch, for example, have been used. Alternatively, a groove 20 formed in the surface of a low-dielectric constant substrate 21 and filled with a high-dielectric constant powder 22, such as shown in FIG. 2, for example, provides an attractive medium for low-cost, complex mm-waveguide components and integrated circuits. Loss per unit length and guide wavelength have been measured for a variety of combinations of dimensions and materials, and losses as low as 10 dB/meter have been obtained at 94 GHz.

As shown in FIG. 2, a rectangular groove 20 is formed, e.g. by milling, into the surface of a low loss (e.g. TFE Teflon) substrate 21 and filled with a high-dielectric constant powder 22 to form the core of a dielectric waveguide. With this configuration, the powder can be packed from the top to assure a sufficiently uniform density along the length of the groove 20. Rectangular grooves with cross-sectional dimensions varying less than 0.002 inches from the specified values can be milled with relative ease in the substrate. This degree of dimensional accuracy is sufficient for good performance at 94 GHz.

With a waveguide, as shown in FIG. 2, the guide wavelength and loss per unit length were measured for the fundamental vertically polarized mode of various powder-filled rectangular groove waveguides, using the set-up shown. On each end of the substrate 21 the dielectric groove 20 was extended with a thin-walled trough 24 of substrate material. Trough 24 is fitted snugly into the ends of slightly flared sections of metal waveguide 25 and 26 at either end, respectively, to couple to the dielectric guide. (Flared section 25 is shown in phantom and exaggerated for illustration.) Lossy inserts 28 (made from Emmerson and Cumming MF-110 absorber, for example) were placed at non-periodic intervals in the substrate 21, 3 mm from groove 20, to attenuate any substrate modes that might be excited at the coupling point.

To measure the waveguide wavelength, a metal perturber 27 was held mechanically just above the surface of the powder 22. The perturber reflects a small fraction of the power traveling along the waveguide toward the feed where it interferes with the reflection from the input coupler 25. The amplitude of this interference changes as the relative phase between the two signals changes. Thus, as the perturber was moved along the length of groove 20, a sequence of maxima and minima in reflected power was sensed with a −10 dB directional coupler 29 and diode detector (e.g. Schottky type) 30. The guide wavelength is twice the distance the perturber is moved between successive minima.

The waveguide wavelengths for various combinations of guide dimensions and dielectric powders were compared to the values predicted by Marcatili's approximate theory (i.e. E. A. J. Marcatili, "Dielectric Rectangular Waveguide and Directional Coupler for Integrated Optics," Bell Syst. Tech. J. Vol. 48, pp. 2071–2102; September 1969) for the fundamental vertically polarized mode. In order to use Marcatili's theory, the dielectric constants of the powders were needed. The density of the powder in the groove was determined by weight measurement, and previously measured curves of dielectric constant verses density were used to find the effective dielectric constant of the powder packed into the groove. The dielectric constants of the powders were measured at 10 GHz using the shortened-waveguide technique. These measurements were made at 10 GHz because of the difficulty of controlling the length of a powder sample sufficiently accurately to measure its dielectric constant at 94 GHz. For low-loss dielectrics, there is not much change expected in dielectric constant between 10 and 94 GHz.

To determine the loss-per-unit length of a groove waveguide, the power transmitted from end-to-end was measured by a detector 31 connected to the flared section of metal waveguide 26 surrounding the trough 24 at the far end of substrate 21. E/H tuners were used to match the coupling sections. The power detected at the far end could not be significantly increased by adjusting the E/H tuners, showing that the couplers were well matched. In addition, removing the lossy inserts 28 from the substrate did not affect the power received at the far end, indicating that little power is lost to substrate modes. A third detector connected to a small horn antenna was used as a movable probe to determine that an insignificant amount of power was radiated from the couplers or waveguide. Finally, the power reflected from the feed 25 was −20 dB down from the incident power. Taken together, these observations indicated that almost all of the incident power was coupled into the dielectric waveguide, so that the difference between the incident power and the power detected at the far end represents dielectric waveguide loss. The loss per unit length is then this loss divided by the length of the dielectric waveguide.

A second method for measuring loss-per-unit length along the powder-filled groove was used as a rough check. A detector with a short section of metal waveguide attached and positioned just above the groove 20 was used as a probe. The probe-to-groove spacing had to be maintained accurately as the probe was moved along the groove. The slope of the detected power (dB) verses distance along the groove also gives the loss-per-unit length in dB/m.

A comparison between the measured values of the dielectric waveguide wavelength with those predicted for the $E_y^{11}$ mode by Marcatili's approximate theory is given below in Table 1 for various high-dielectric constant powders in a Teflon substrate at 94 GHz.

TABLE 1

| Type of Powder | Width of Groove (mm) | Depth of Groove (mm) | Powder Density (g/cm3) | Dielectric Constant | λg (meas.) (mm) | λg (Marcatili) (mm) |
|---|---|---|---|---|---|---|
| 1 | 1.14 | 1.22 | 1.69 ± .05 | 4.43 ± .25 | 1.86 | 2.00 ± .07 |
| 1 | 0.94 | 0.94 | 1.95 ± .07 | 5.78 ± .35 | 1.86 | 1.96 ± .08 |
| 2 | 1.12 | 1.12 | 1.77 ± .04 | 5.0 ± .4 | 2.06 | 1.9 ± .1 |
| 3 | 1.14 | 1.12 | 1.82 ± .03 | 4.68 ± .12 | 2.18 | 1.98 ± .04 |
| 3 | 1.04 | 1.04 | 1.95 ± .03 | 5.29 ± .15 | 2.12 | 1.93 ± .04 |

Powder 1 is nickel-aluminum-titanate (Trans-Tech D-30).
Powder 2 is barium tetra-titanate (Trans-Tech D-38).
Powder 3 is barium tetra-titanate (Trans-Tech D-8512).

The uncertainty in the waveguide wavelength predicted by Marcitili's theory is estimated from the uncertainty in the dielectric constant of the powder.

The results of measurements of the loss per unit length along a straight powder-filled groove in a Teflon substrate are given below in Table 2.

TABLE 2

| Type of Powder | Width of Groove (mm) | Depth of Groove (mm) | Density of Powder (gm/cm3) | Technique | Loss (dB/cm) |
|---|---|---|---|---|---|
| 1 | 1.14 | 1.22 | 1.44 | movable detector | 0.57 ± .08 |
| 1 | 1.14 | 1.22 | 1.44 | end-to-end transmission | 0.48 |
| 1 | 1.14 | 1.12 | 1.44 | end-to-end transmission | 0.43 |
| 3 | 1.14 | 1.12 | 1.82 | end-to-end transmission | 0.21 |
| 3 | 1.04 | 1.04 | 1.95 | end-to-end transmission | 0.27 |

Powder 1 and Powder 3 = same as in Table 1.

Any suitable low-dielectric constant low-loss flexible polymer (e.g. Teflon, polypropylene, polyethylene, etc.) or other form means may be used for the jacket or tubing 10, as shown in FIG. 1, and any suitable low loss, high-dielectric constant materials available for the millimeter wave range (e.g. GaAs, silicon, barium tetra-titanate, nickel-aluminum-titanate, etc.) in finely powdered form may be packed within the tubing to form a flexible waveguide. The various aforementioned low power loss, high dielectric constant powders are inherently non-transparent to visible light. Complicated configurations of directional couplers, filters, etc. may be fabricated by filling the voids in a thin vacuum-formed plastic sheet (similar to "bubble-pack"). Such an assembly can stand alone as a true dielectric waveguide, or be capped with a metal plate to form image guide. Using a dielectric in powder form rather than solid form allows a much wide choice of materials to be used when flexibility is required. It also allows complex shapes to be machined or moulded and then filled with powdered dielectric much like pouring in a liquid. (But true liquids are notoriously lossy at the high microwave frequencies.) These techniques will allow the manufacture of complex circuits and flexible, semi-rigid, and rigid waveguides at much lower cost than conventional metallic waveguides.

Figure 3:
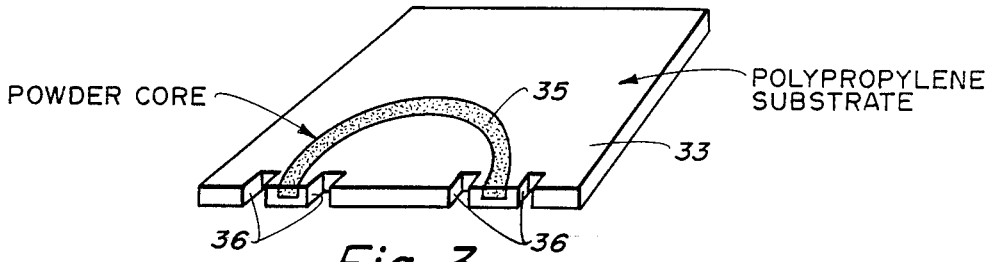
FIG. 3 illustrates a curve section of powder core waveguide formed in a rigid or semi-rigid substrate.

The curved section of waveguide, as shown in FIG. 3, consists of a substrate 33, of polypropylene for example, having a semi-circular groove formed therein which is filled with a high-dielectric constant powdered core 35. Slots 36 in the substrate provided for connection to a flared metal waveguide coupler, and operate much like the trough sections 24 in FIG. 2.

Figure 4:
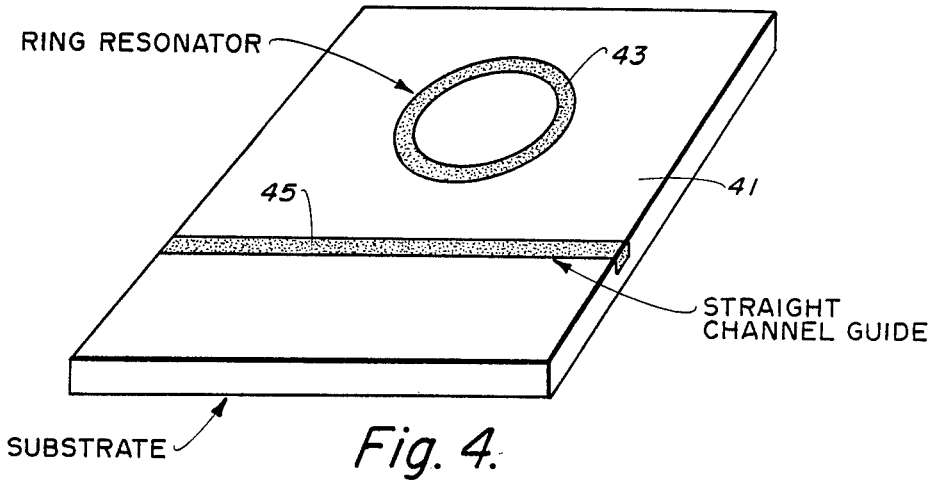
FIG. 4 shows a ring resonator device formed of powder core waveguide in a low dielectric constant substrate.

The ring resonator illustrated in FIG. 4 consists of a low-loss dielectric substrate 41 having having a circular groove formed into the substrate and filled with a high-dielectric constant powder core 43. Ring resonator 43 is located nearby to a straight channel waveguide 45, similar to 22 of FIG. 2, for coupling thereto, and operates as a filter.

Figure 5:
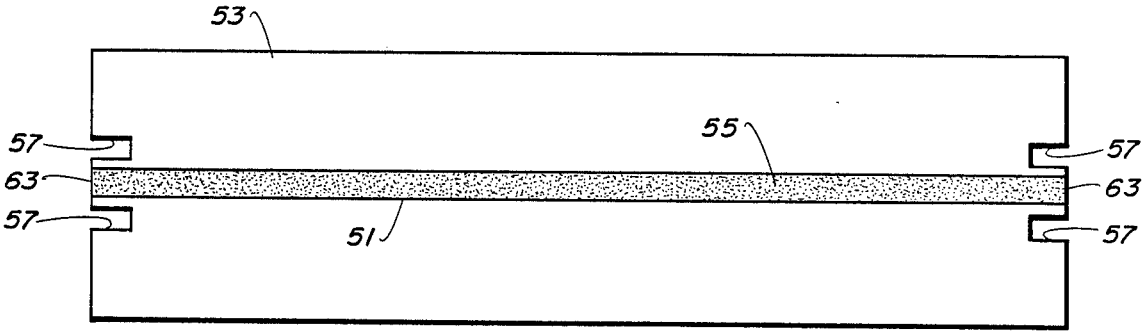
FIG. 5 is an illustration of a straight channel powder core waveguide section similar to that of FIG. 2, but with slots for coupler connection like that of FIG. 3.
Figure 6:
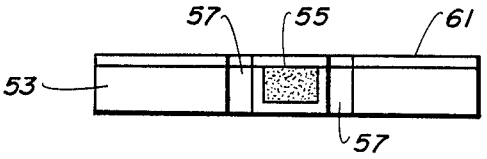
FIG. 6 is an end view of a waveguide section as in FIG. 5, showing a top cover for retaining the powdered waveguide core.

The straight channel waveguide shown in FIG. 5 is similar to that shown in the measurements set-up of FIG. 2. As shown in FIG. 5 a groove 51 is formed in a substrate 53 of rigid or semi-rigid low-dielectric constant material and filled with a high-dielectric constant powder core 55. Slots 57 at either end of the waveguide section operate for connection of waveguide couplers. A sheet of low-dielectric constant material 61, similar to that used for the substrate 53, can be used to retain the powdered core 55 within groove 51, as shown in the end view of FIG. 6. A thin film of very low-dielectric constant material 63 (FIG. 5) may be used to prevent any of the high-dielectric constant powder 55 from spilling at the ends of groove 51. Any suitable technique using low-dielectric constant material may be used to retain the powdered core within the desired waveguide configuration. While only a few examples of the waveguides of this invention have been described it will be apparent to those having knowledge in this field that numerous varieties and shapes of waveguide can be produced by the techniques described herein.

Obviously many modifications and variations of the present invention are possible in the light of the above teachings. It is therefore to be understood that within the scope of the appended claims, the invention may be practiced otherwise than as specifically described.

What is claimed is:

1. A low-loss dielectric waveguide for replacing conventional electrical metallic waveguides and integrated circuits, comprising:

(a) a waveguide housing made from a section of flexible low dielectric constant tubing which is operable to readily be bent to conform to any of various desired electrical waveguide and integrated circuit component shapes;

(b) the interior of said section of flexible low dielectric constant tubing being entirely filled with a loose powder having low-loss and a high dielectric constant to provide a purely powdered waveguide core therein which conforms to the interior configuration of said flexible tubing;

(c) a very low dielectric constant sealing means provided at opposite ends of said section of flexible low dielectric constant tubing for retaining said low-loss, high dielectric constant powder within said section of flexible low dielectric constant tubing and preventing spilling of said low-loss, high dielectric constant powder; wherein said waveguide can be bent to physically conform to the shape of various electrical waveguide and integrated circuit components as desired.

2. A low-loss dielectric waveguide as in claim 1, wherein said flexible low dielectric constant tubing comprises flexible polymer tubing.

3. A low-loss dielectric waveguide as in claim 1, wherein said high dielectric constant powder is barium tetra-titanate.

4. A low-loss dielectric waveguide as in claim 1, wherein said high dielectric constant powder is nickel-aluminum-titanate.

5. A low-loss dielectric waveguide as in claim 1, wherein said high dielectric constant powder is gallium arsenide.

6. A low-loss dielectric waveguide as in claim 1, wherein said high dielectric constant powder is silicon.

7. A low-loss dielectric waveguide as in claim 1, wherein said flexible tubing is formed from Teflon.

8. A low-loss dielectric waveguide for replacing conventional electrical metallic waveguides and integrated circuits, comprising:

(a) a housing consisting of a substrate of low dielectric constant material having at least one groove formed therein of desired electrical waveguide circuit configuration;

(b) the interior of said at least one groove being entirely filled with a loose powder consisting solely of a low-loss and high dielectric constant homogeneous material to provide a purely powdered core therein;

(c) means for retaining said high dielectric constant powder within said at least one low dielectric constant housing groove and for preventing spilling of said high dielectric constant powder therefrom;

(d) means for waveguide coupling said powdered core into an electrical circuit.

9. A low-loss dielectric waveguide as in claim 8, wherein said substrate is made from Teflon.

10. A low-loss dielectric waveguide as in claim 8, wherein said substrate is made from polypropylene.

11. A low-loss dielectric waveguide as in claim 8, wherein a ring groove is formed in said substrate at a predetermined distance from said waveguide groove and filled with a high dielectric constant powder that is retained therein, forming a ring resonator.

12. A low-loss dielectric waveguide as in claim 8, wherein a thin layer of very low dielectric constant material is provided at ends of the groove for preventing said high dielectric constant powder from spilling from the ends thereof.

13. A low-loss dielectric waveguide as in claim 8, wherein said means for waveguide coupling to said powdered waveguide core are slots in the edges of said low dielectric constant substrate at the ends of said groove containing said powdered waveguide core.

14. A low-loss dielectric waveguide as in claim 8, wherein a low dielectric constant cover is provided to retain said high dielectric constant powder within said groove.

15. A low-loss dielectric waveguide as in claim 8 wherein various configurations of electrical waveguide circuits and components, including resonators, filters, and couplers are also made from additional powdered waveguide cores provided within additional grooves formed in said waveguide substrate that are appropriately shaped as said waveguide circuits and components.

16. A low-loss dielectric waveguide as in claim 8, wherein said low-loss high dielectric constant powder is gallium arsenide.

17. A low-loss dielectric waveguide as in claim 8, wherein said low-loss high dielectric constant powder is barium tetra-titanate.

18. A low-loss dielectric waveguide as in claim 8, wherein said low-loss high dielectric constant powder is nickel-aluminum-titanate.

* * * * *